US008375680B2

(12) United States Patent
Clair et al.

(10) Patent No.: US 8,375,680 B2
(45) Date of Patent: Feb. 19, 2013

(54) INSULATED GLASS UNIT (IGU) AND A POINT FIXING APPARATUS FOR AN IGU

(75) Inventors: Murray Robert Clair, Wallsend (AU); Craig Adam McWilliam, Medowie (AU)

(73) Assignee: Nupress Tools Pty Limited, Cardiff (AU)

( * ) Notice: Subject to any disclaimer, the term of this patent is extended or adjusted under 35 U.S.C. 154(b) by 0 days.

(21) Appl. No.: 12/723,549

(22) Filed: Mar. 12, 2010

(65) Prior Publication Data

US 2011/0023391 A1 Feb. 3, 2011

Related U.S. Application Data

(63) Continuation-in-part of application No. 12/594,329, filed as application No. PCT/AU2008/000464 on Apr. 2, 2008.

(60) Provisional application No. 60/907,426, filed on Apr. 2, 2007.

(51) Int. Cl.
*E04C 2/54* (2006.01)

(52) U.S. Cl. ..... 52/786.13; 52/204.593; 52/204.65; 52/787.1

(58) Field of Classification Search ..... 52/171.3, 52/204.5, 209, 204.52, 204.593, 204.595, 52/364, 635, 786.1, 786.13, 787.1, 172, 204.62–204.65, 52/34; 428/34

See application file for complete search history.

(56) References Cited

U.S. PATENT DOCUMENTS

| | | | | |
|---|---|---|---|---|
| 4,581,868 | A * | 4/1986 | McCann | 52/204.593 |
| 4,893,443 | A | 1/1990 | Haber | |
| 5,497,586 | A * | 3/1996 | Dodd et al. | 52/172 |
| 5,540,514 | A * | 7/1996 | Demars et al. | 403/388 |
| 5,921,698 | A * | 7/1999 | Hegen et al. | 403/263 |
| 6,105,319 | A * | 8/2000 | Brunt | 52/204.593 |
| 6,138,434 | A | 10/2000 | Demars et al. | |
| 6,430,894 | B1 * | 8/2002 | Chae et al. | 52/786.1 |
| 6,623,203 | B2 * | 9/2003 | Kreyenborg et al. | 403/374.3 |
| 7,155,869 | B2 * | 1/2007 | Wildenhain et al. | 52/506.05 |
| 2001/0000274 | A1 * | 4/2001 | Elmer et al. | 52/235 |
| 2011/0023391 | A1 | 2/2011 | Clair et al. | |

FOREIGN PATENT DOCUMENTS

| | | | |
|---|---|---|---|
| CH | 696590 | A5 * | 8/2007 |
| EP | 0801201 | A1 | 10/1997 |
| EP | 0965721 | A1 | 12/1999 |
| EP | 1104835 | A1 | 10/2002 |
| JP | 9088223 | | 3/1997 |
| JP | 9111933 | | 4/1997 |
| JP | 2000104456 | | 4/2000 |

OTHER PUBLICATIONS

Clair, Murray Robert et al., "An Insulated Glass Unit (IGU) and a Point Fixing Apparatus for an IGU," Office Action dated Jul. 29, 2011, for AU2008234426, 1 page.

(Continued)

*Primary Examiner* — Brian Glessner
*Assistant Examiner* — Brian D Mattei
(74) *Attorney, Agent, or Firm* — Seed IP Law Group PLLC

(57) ABSTRACT

A device (1) for providing a fixing point for an insulated glass unit (3), the device having clamping blocks (22) to mount the device (1) though opposed panes of glass (5, 6) of the unit (3) and a spacer (10) with opposed faces (13, 14). At least one of the opposed faces (13, 14) having an annular groove (17, 18) for carrying sealant to seal against an associated one of the glass panes (5, 6) when the glass panes (5, 6) are tensioned together by the clamping blocks (22).

17 Claims, 15 Drawing Sheets

OTHER PUBLICATIONS

Clair, Murray Robert et al., "An Insulated Glass Unit (IGU) and a Point Fixing Apparatus for an IGU," Office Action dated Nov. 14, 2011, for AU2008234426, 3 pages.

Clair, Murray Robert et al., "An Insulated Glass Unit (IGU) and a Point Fixing Apparatus for an IGU," Office Action dated Feb. 7, 2012, for AU2008234426, 2 pages.

Clair, Murray Robert et al., "An Insulated Glass Unit (IGU) and a Point Fixing Apparatus for an IGU," Office Action dated Nov. 14, 2011, for AU2010200804, 3 pages.

Clair, Murray Robert et al., "An Insulated Glass Unit (IGU) and a Point Fixing Apparatus for an IGU," Office Action dated Feb. 7, 2012 for AU2010200804, 2 pages.

Written Opinion dated Oct. 18, 2011, for PCT/AU2011/001164, 5 pages.

International Search Report dated Oct. 18, 2011, PCT/AU2011/001164, 3 pages.

* cited by examiner

INSULATED GLASS UNIT (IGU) AND A POINT FIXING APPARATUS FOR AN IGU

FIELD OF THE INVENTION

The present invention relates generally to insulated glass units (IGUs), devices for mounting IGUs and a method of mounting IGUs.

BACKGROUND OF THE INVENTION

Insulated Glass Units (IGUs), also known as double glazing units, are generally formed from two spaced apart panes of glass separated by a peripheral spacing frame. The frame and glass forms a hermetically sealed chamber so as to provide a transparent insulating barrier. However, the peripheral frames are bulky, expensive and unsightly, and interfere with the view through the glass panels, especially when an IGU glass wall is formed by abutting several IGUs together in an edge to edge manner.

Other arrangements use point fixing structures which have a spacer between the glass panels to mount the IGUs. Point fixing devices allow the use of much slimmer peripheral frames.

One particular known point fixing structure is disclosed in JP 2000104456 A. This structure includes a spacer, for providing an air gap, between an inner and an outer glass panel, the spacer being arranged such that inner faces of the inner glass panel and the outer glass panel directly abut the respective faces of the spacer. This structure further includes a cylindrical collar assembly comprising several parts inserted central to the spacer. In this configuration, a void is formed between an inner radial surface of the spacer and an outer radial surface of the collar assembly.

To seal the air gap from the external environment, a sealant is disposed within the void and a bolt is inserted central to the collar assembly. An oversized nut is then engaged to a threaded end of the bolt and tightened such that the inner and outer glass panels are clamped against the spacer. During clamping, the sealant is squeezed into and retained in the void by the inner surface of the over sized nut, and the collar assembly serves to prevent over tightening.

A disadvantage with this type of point fixing structure is that the collar comprises a stacked arrangement of multiple parts with different compression characteristics and variable dimensions. Accordingly, it is difficult to ensure the height of the overall collar assembly is reliably within tolerances required to provide accurate compression when tightening the nut. For example, when the glass panels are clamped against the spacer, the components of the collar assembly, such as the sealant and sealing washers are squeezed by differing degrees. Furthermore, as multiple parts of the collar assembly may need to be inserted by hand, it is difficult to automate the manufacturing process of an IGU.

Another disadvantage of this type of point fixing structure is that it may be difficult to assemble an IGU unit when the glass panels are in a vertical orientation, which is advantageous in an assembly line. For example, the main sealant of JP 2000104456 A would likely not be held in place during manufacture between the inner radial surface of the spacer and an outer radial surface of the collar assembly, if the glass unit was constructed in a vertical orientation.

Yet another disadvantage of this type of point fixing structure is that the spacer serves only to hold the glass panels in spaced relation. The spacer does not directly retain any sealant which can be used as a seal to retain air in the air gap, and also ensure unified fit with the glass panels which may have surfaces that are not entirely congruent with the respective faces of the spacer.

The present invention seeks to ameliorate one or more of the above-mentioned disadvantages.

SUMMARY OF THE INVENTION

In accordance with the invention, there is provided a device for providing a fixing point for an insulated glass unit, the device having clamping blocks to mount the device in holes provided in opposed panes of glass of the unit and a unitary spacer with opposed faces provided with an annular groove for carrying sealant to seal against an associated one of the glass panes when the glass panes are tensioned together by the clamping blocks, wherein the spacer includes a flange to locate the spacer in one of the holes and wherein the spacer provides a solid unitary body that extends from the bore through to a periphery thereof and the annular grooves are in the form of wells recessed into opposed sides of the body and adapted to receive the sealant prior to the spacer being fitted between the panes of glass.

In another aspect, there is provided a spacer for use in the device described above, the spacer being formed as a unitary structure with a flattened donut shape, with annular grooves formed on opposed faces thereof, and an integrally formed flange to locate the spacer in a corresponding hole formed in a pane of glass, wherein the spacer provides a solid unitary body that extends from the bore through to a periphery thereof and the annular grooves are in the form of wells recessed into opposed sides of the body and adapted to receive the sealant prior to the spacer being fitted between the panes of glass.

In another aspect, there is provided a method of mounting the device, described above, in holes formed in first and second panes of opposed panes of glass, including: fitting the flange of the spacer in the hole of the first pane to thereby locate the spacer over the hole; and pressing the spacer between the first pane and a second pane of glass, to engage the sealant and seal the spacer against both panes of glass.

In another aspect, there is provided a glass unit formed in accordance with the abovedescribed method, with a plurality of devices mounted thereto, to allow for multiple point fixing of the unit.

In yet another aspect, there is provided a clamping block structure, for use in the above described device.

Preferably, the sealant is filled into the groove, before attaching the spacer to the panes of glass, to a depth at least as deep as the groove.

Preferably, polyisobutylene sealant is filled into an annular groove on each opposed face of the spacer.

Preferably, the method includes the step of fitting a flange of the spacer in the hole of the first pane of glass to thereby locate the spacer over the hole.

Preferably, the method includes the step of coupling clamping blocks together through a bore defined by the spacer, from opposite sides of the panes of glass; tensioning the blocks to squeeze the panes of glass together; and providing a stop device on the blocks to prevent overtensioning of the panes.

Preferably, the method includes the step of coupling the blocks together by fitting one of the blocks, in the form of a nut, onto a threaded shaft of the other block and screw threading the nut into tensioned engagement with the nut.

Preferably, the method further includes the step of fitting a bush to one of the glass panes and seating an associated one of the clamping blocks, in the form of a threaded bolt, in the bush for connection to the other one of the blocks.

Preferably, the method further includes the step of providing a seal between the bush and the glass pane and between the bush and the bolt.

Preferably, the method further includes providing a bush for each of the clamping blocks and counter sinking the bushes in the glass panes.

In accordance with yet another aspect of the invention, a glass unit is formed in accordance with the method defined above, with a plurality of devices mounted thereto, to allow for multiple point fixing of the unit.

Preferably, the devices are profiled to allow the unit to be flat packed, wherein the devices are also adapted to carry an articulated ball joint for mounting the glass unit to a supporting structure.

In accordance with yet another aspect of the invention, there is provided a clamping block structure for an insulated glass unit, including bushes which fit in holes of opposed panes of glass, clamping blocks in the form of threaded bolts arranged to be seated in the associated bushes and to be coupled together through the unit, wherein the clamping blocks carry a stop device to inhibit over tensioning of the panes of glass clamped between the blocks.

In accordance with yet another aspect of the invention, there is provided a clamping block structure for an insulated glass unit, including clamping blocks seated on opposed panes of glass, wherein the clamping blocks are coupled together by a threaded coupling which passes through the unit, the threaded coupled having a stop device to inhibit over tensioning of the panes of glass clamped between the clamping blocks.

In accordance with yet another aspect of the invention, there is provided a clamping block structure for an insulated glass unit, including a bush which fits in a hole of a first pane of glass and clamping blocks in the form of a bolt with opposed first and second ends; wherein a first end is configured to be seated in the bush and a second end seated on an outer surface of a second pane of glass when the bolt is coupled together through the unit; wherein the clamping blocks carry a stop device to inhibit over tensioning of the panes of glass clamped between the blocks.

BRIEF DESCRIPTIONS OF THE DRAWINGS

The invention is described, by way of non-limiting example only, with reference to the accompanying drawings, in which.

Figure 10B:
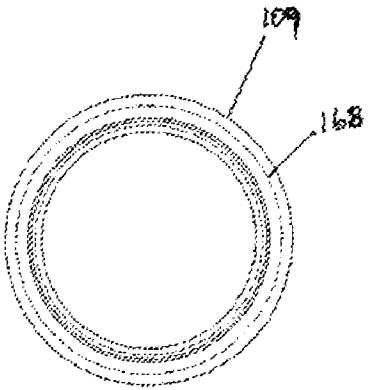
Figure 10A:
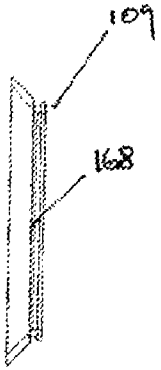
Figure 11B:
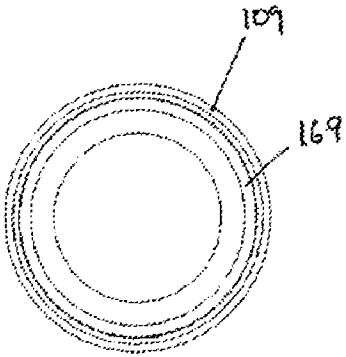
Figure 11A:
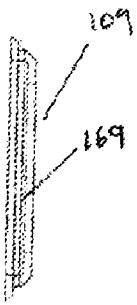
Figure 12A:
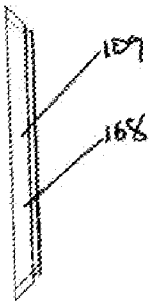
Figure 12B:
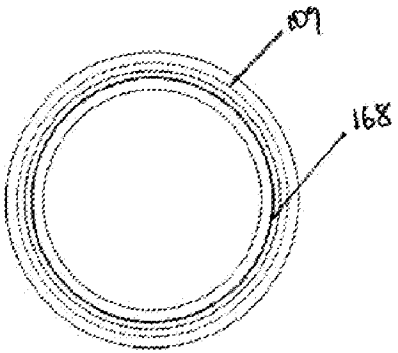
Figure 13A:
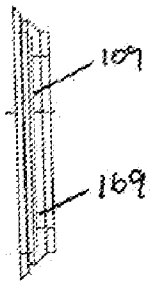
Figure 13B:
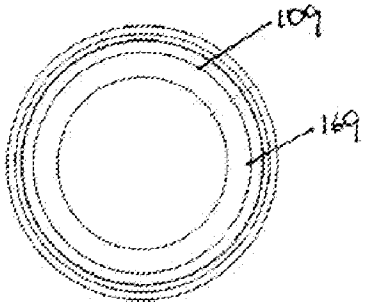
Figure 14B:
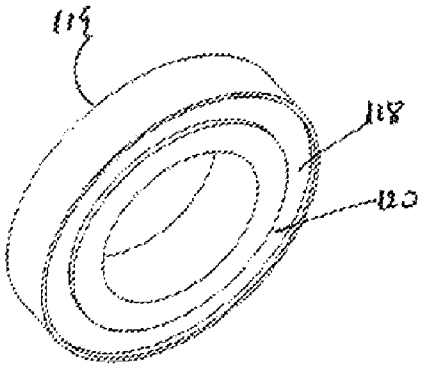
Figure 14C:
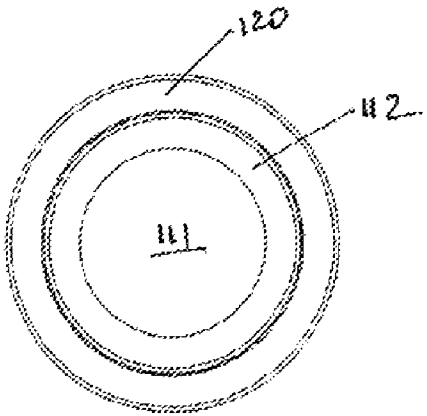
Figure 14A:
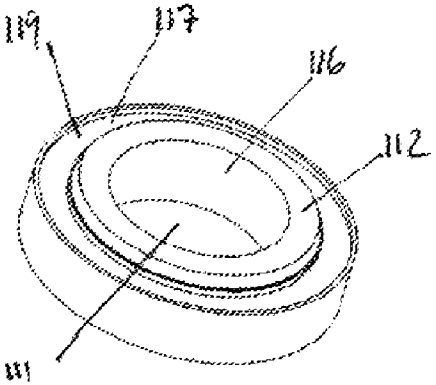
Figure 15:
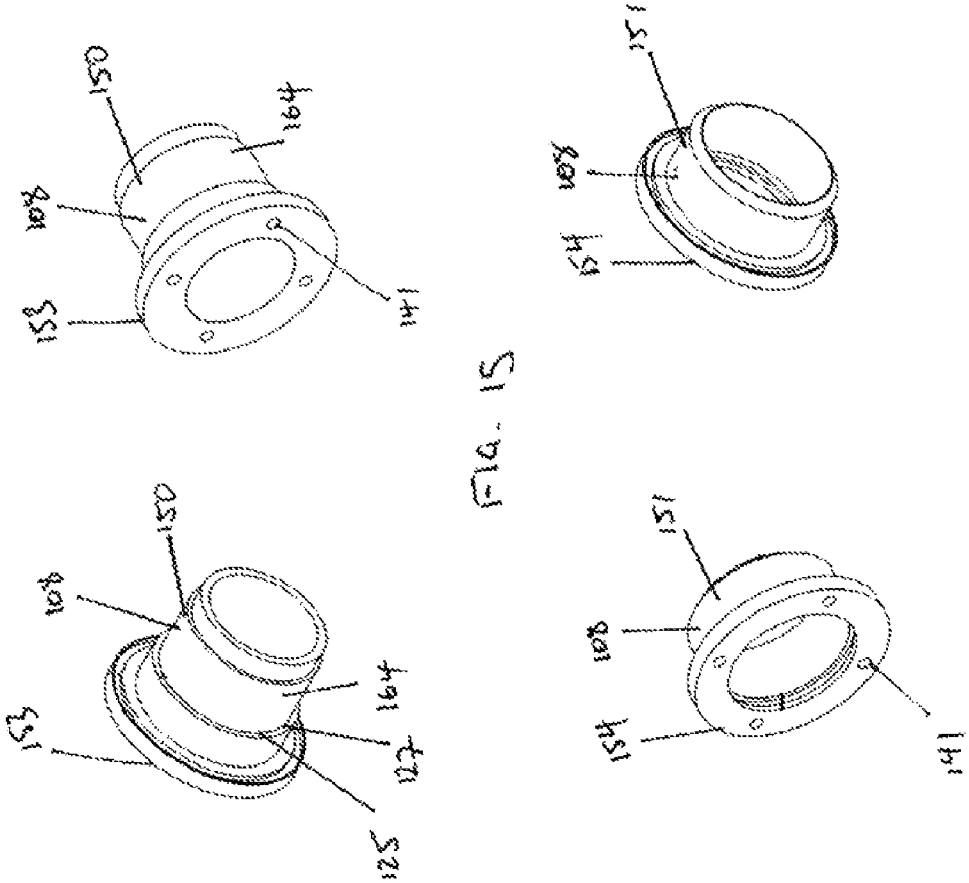
Figure 16A:
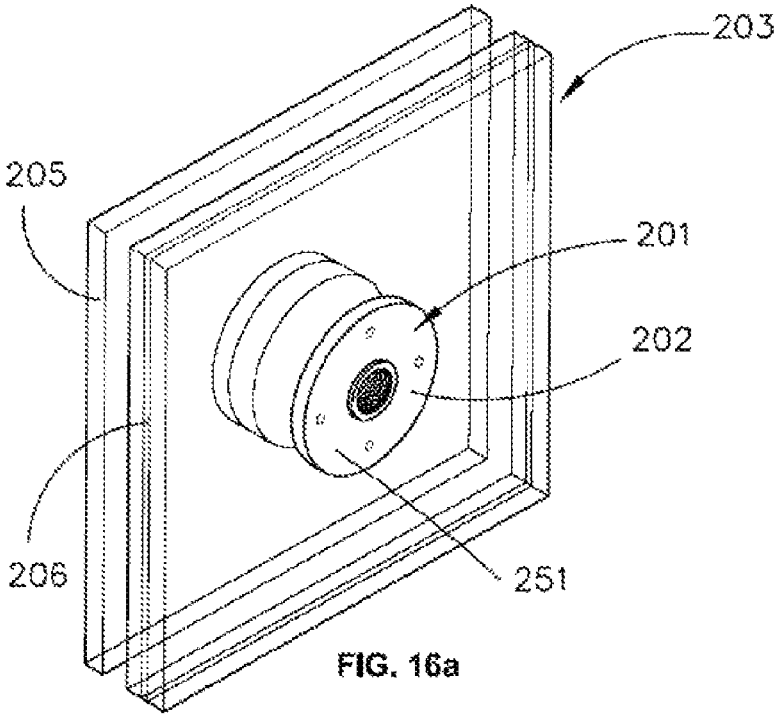
Figure 16B:
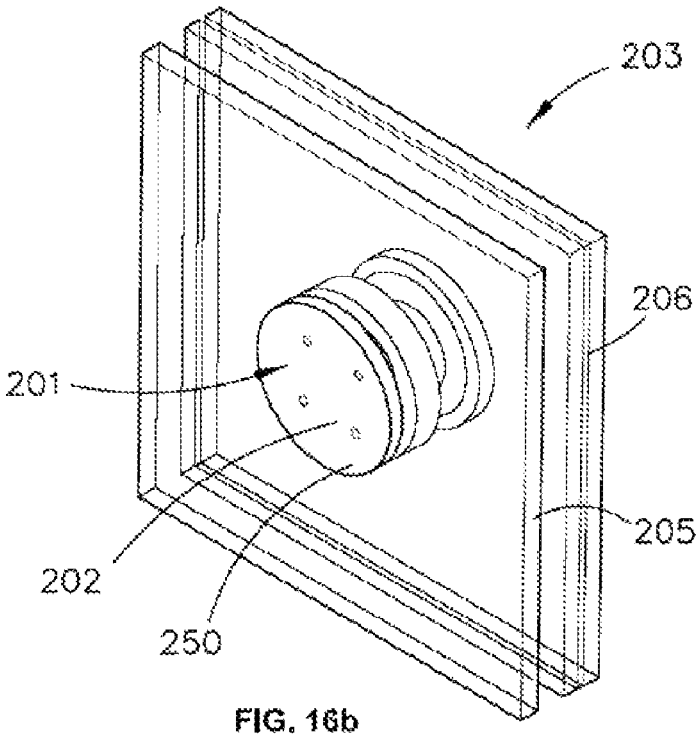
Figure 17A:
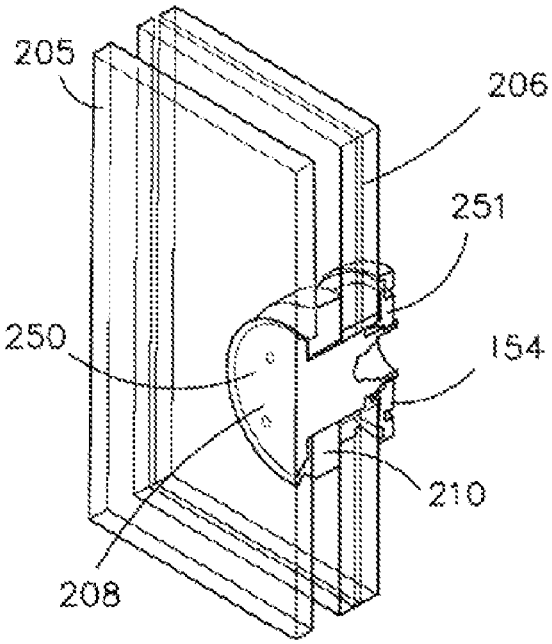
Figure 17B:
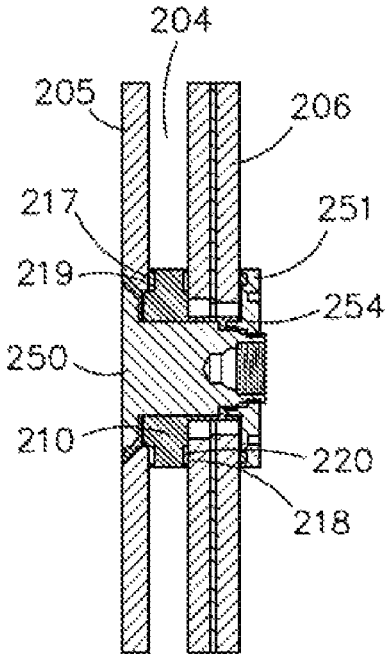
Figure 17C:
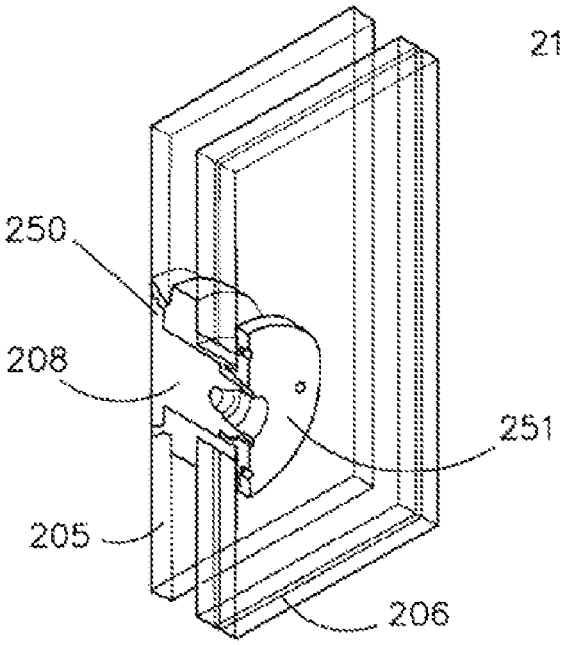
Figure 18:
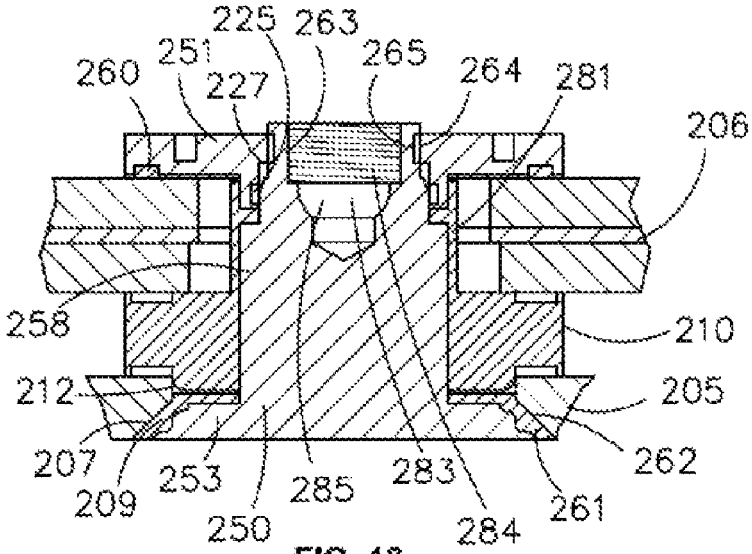
Figure 19:
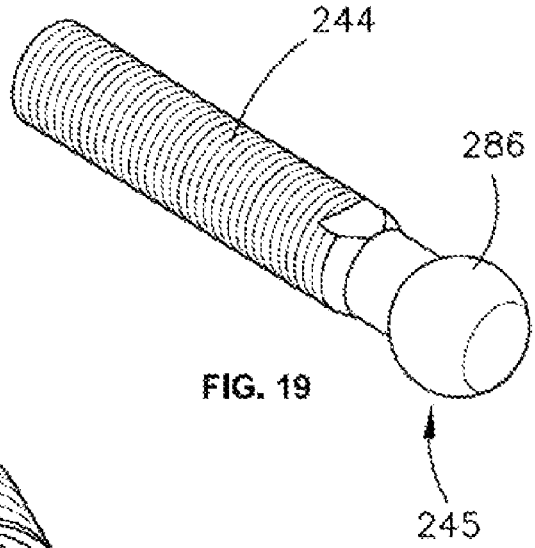
Figure 20:
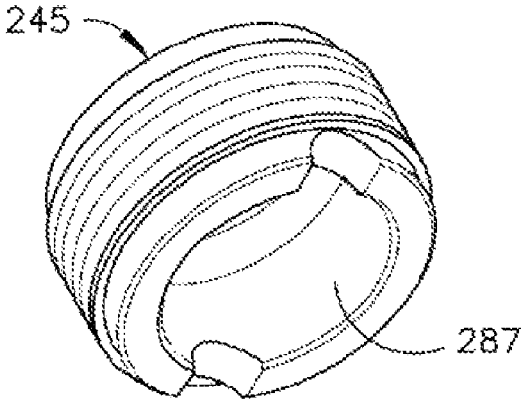
Figure 21A:
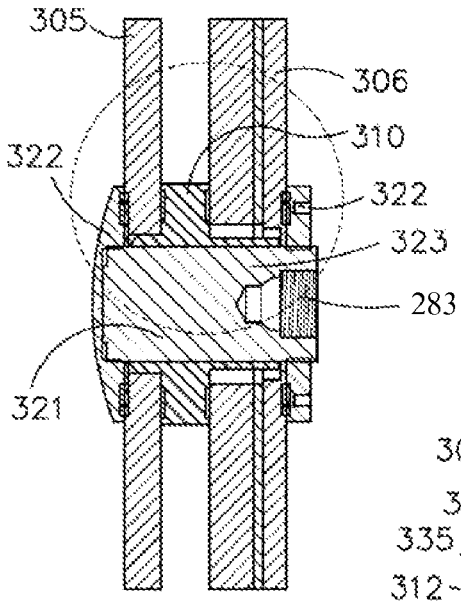
Figure 21B:
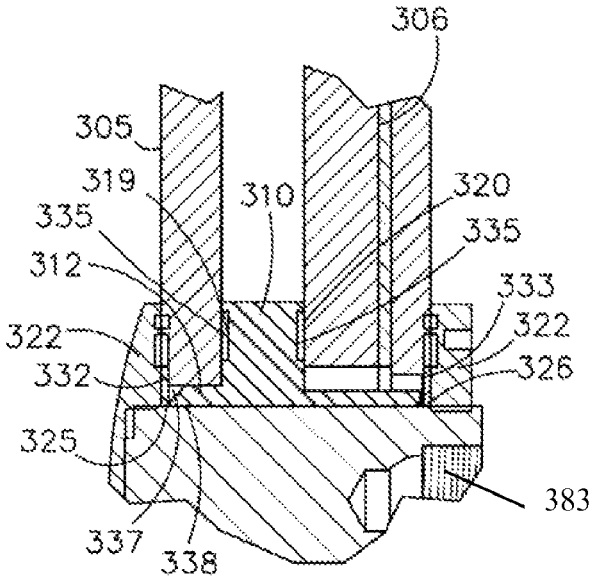
Figure 22:
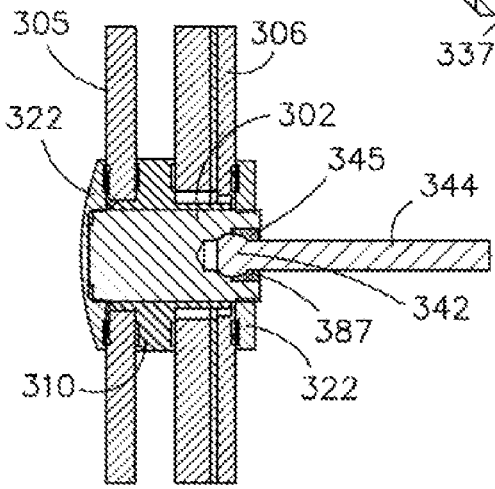

FIGS. 10*a* and 10*b* show respectively a side and a front view of a seating portion of a countersunk bush;

FIGS. 11*a* and 11*b* show respectively a side and a front view of an insert portion of a countersunk bush;

FIGS. 12*a* and 12*b* show respectively a side and a front view of a seating portion of a countersunk bush;

FIGS. 13*a* and 13*b* show respectively a side and a front view of an insert portion of a countersunk bush;

FIGS. 14*a*-14*c* show several isometric views of a spacer used in the second embodiment;

FIG. 15 shows several isometric views of first and second ends of a shee bolt which is used in the second example;

FIGS. 16*a* and 16*b* show isometric views of a third example of the point fixing apparatus;

FIG. 17*a* is an isometric cutaway view of the point fixing apparatus;

FIG. 17*b* is a side cutaway view of the point fixing apparatus;

FIG. 17*c* is another isometric cutaway view of the point fixing apparatus;

FIG. 18 is a detailed cutaway view of the point fixing apparatus;

FIG. 19 is an isometric view of the stem;

FIG. 20 is an isometric view of the threaded collar;

FIG. 21*a* is a side cutaway view of a forth example of the point fixing device;

FIG. 21*b* is a detailed view of the point fixing device shown in FIG. 21*a*; and FIG. 22 is a side cutaway view of the point fixing device with the articulated ball joint assembly.

DETAILED DESCRIPTION OF THE INVENTION

Figure 2:
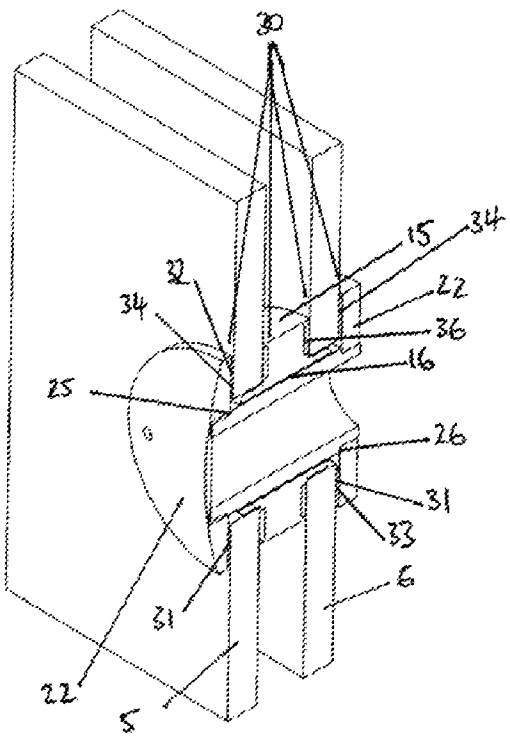
FIG. 2 is a perspective view of the apparatus shown in FIG. 1.
Figure 1:
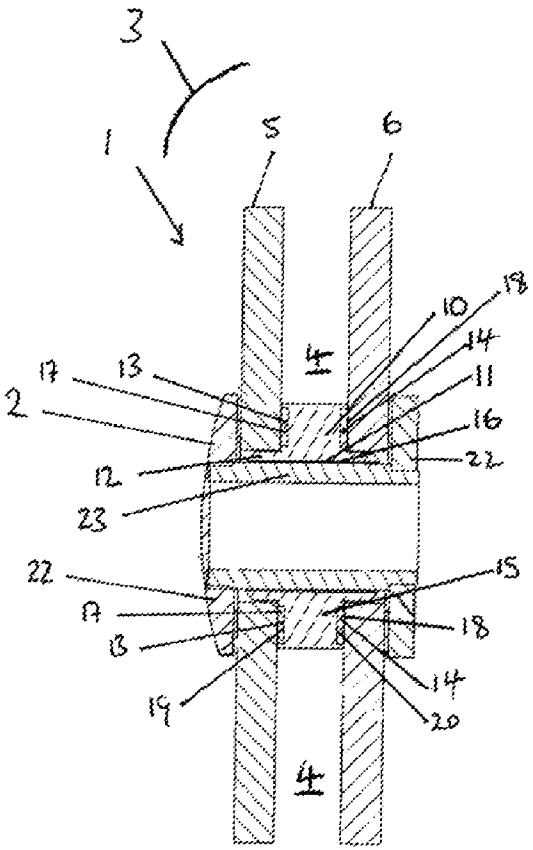
FIG. 1 is a section view of a point fixing apparatus shown mounted on an insulated glass unit (IGU) in accordance with a first example of the present invention.
Figure 3:
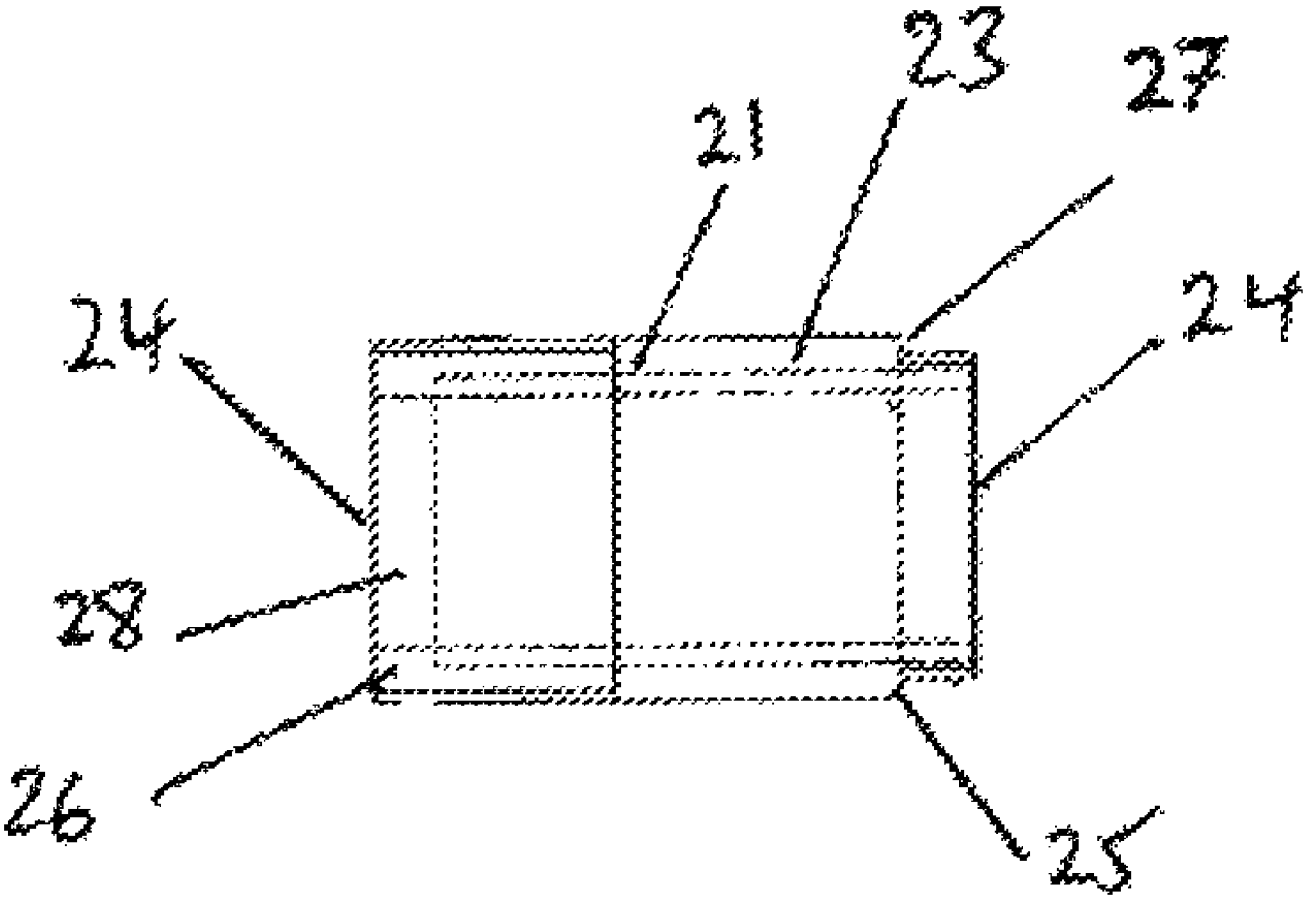
FIG. 3 is a side elevation view of an axle which is a component of the apparatus shown in FIG. 1.
Figure 4:
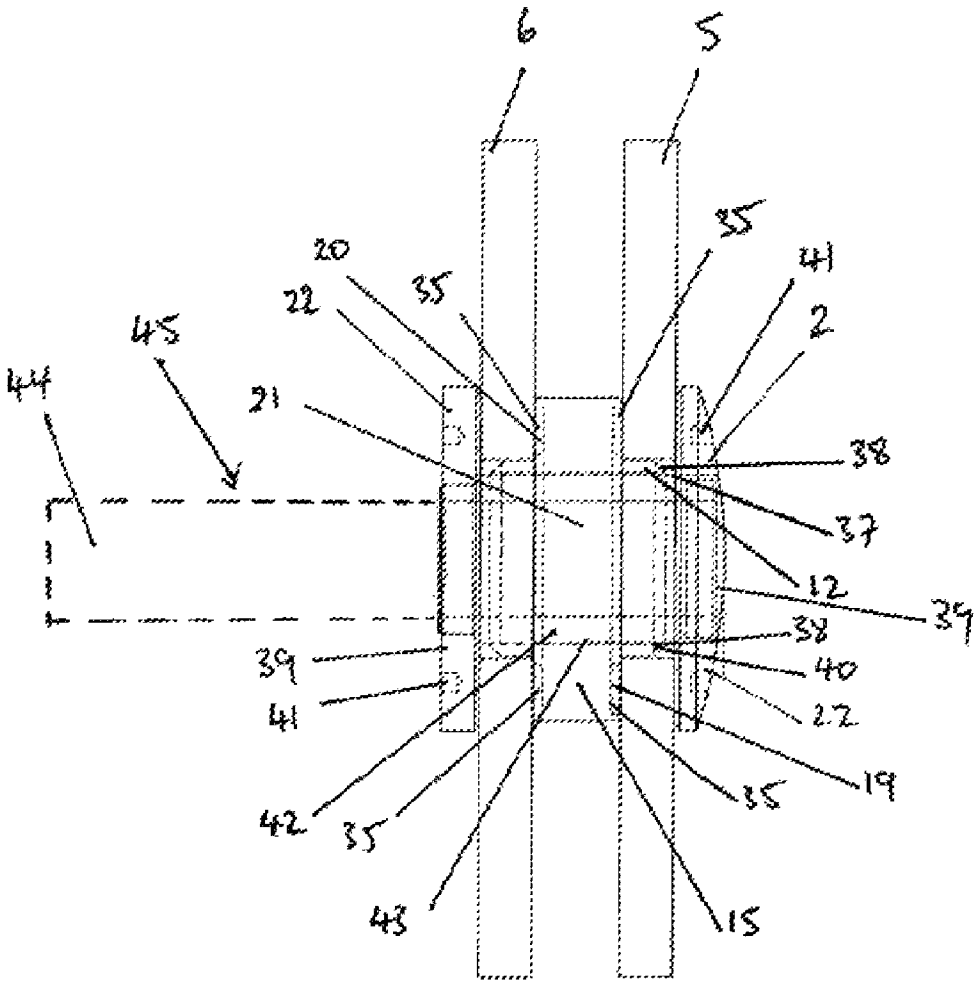
FIG. 4 is a side elevation view of the apparatus shown in FIG. 1 with hidden detail shown.

Referring to FIG. 1 there is shown an example of a mounting device, generally indicated at 1, which comprises a point fixing apparatus 2 for use in assembly of and supporting an insulated glass unit (IGU) 3. The IGU 3 may be a window with an insulating chamber 4, for retaining a gas such as argon gas, disposed between at least two spaced apart panes of glass 5 and 6. Typically, the panes 5 and 6 are sealed around their peripheral region so as to provide the sealed insulating chamber 4.

FIGS. 1 to 4 show a point fixing apparatus 2 for mounting the IGU 3. The point fixing apparatus 2 includes a spacer 10 which in use is disposed between the two panes of glass 5 and 6. The spacer 10 includes a through bore 11 and a pane locating and support flange 12 extending from faces 13 and 14. The spacer 10 is generally shaped as a donut 15 and includes a circumferential face 16 and the two end spacer faces 13 and 14 which have annular grooves 17 and 18 forming wells 19 and 20.

An axle 21 is provided so as to support clamping blocks 22. In use, the axle 21 is inserted through the bore 11 of the spacer 10, the bore 11 being smooth sided to allow the axle 21 to slide easily therethrough. Furthermore, the axle 21 includes shaft 23 having threaded ends 24 onto which the clamping blocks are coupled. The axle 21 also includes stops 25 and 26 so as to inhibit clamping blocks 22 from overtightening the point fixing apparatus 2. The stops 25 and 26 are, respectively formed of a shoulder 27 and axle end 28 on the shaft 23.

The device includes a seal apparatus 30 to seal gas, such as an inert gas within the insulating chamber 4 from the external environment (not shown). The seal apparatus 30 includes a first seal element 31 in the form of structural washers 32 and 33 which are constructed from silicone 34 in order to provide suitable flexibility, sealing and frictional and structural support for the panes 5 and 6.

The seal apparatus 30 also includes a second seal element 35 in the form of a flexible polyisobutylene (PIB) sealant 36.

The PIB sealant 36, when the apparatus 2 is assembled, is applied in a 5.5 mm diameter bead to the spacer faces 13 and 14, in the wells 19 and 20.

The seal apparatus 30 further includes a second well (or chamber) 37 for receiving flexible PIB sealant adjacent the flange 12. A bevel 38 at the end of the flange 12 increases the size of the second well 37 so that a secure flexible PIB seal may be effected between the panes 5 and 6, the flanges 12 and internal diameters of the washers 32 and 33. The volume of the second well 37 and hence the seal is maintained by the stops 25 and 26 which inhibit the clamping blocks 22 from squeezing out all the PIB sealant when tightened. The stops 25 and 26 at their minimum spacing, generally define a separation distance which is a minimum specified thickness of glass panes 5 and 6, less a small separation for compression of the silicone washers 32 and 33.

Advantageously, as may be appreciated from the above, the volume of the second well 37 is maintained by the various features of the preferred embodiments, being the frictional engagement of the silicone washers 32 and 33 with the panes 5 and 6, and the stops 25 and 26 so that the apparatus 2 does not require a cured wet connection before the IGU 3 may be moved or installed.

To assemble the point fixing apparatus 2, a first pane 5 waits at an assembly station on a production line (not shown). The pane 5 has a peripheral bead of PIB sealant applied around its peripheral edges (not shown). The spacer 10 is loaded with 5.5 mm diameter beads of PIB on both faces 13 and 14, in the wells 19 and 20. The flange 12 of the spacer 10 is then inserted into a hole of the pane 5 which a diameter sized large enough to allow passage of the flange 12 yet small enough to provide circumferential abutment of the face 13 of the spacer 10 with the first pane 5. The spacer 10 is then squeezed against the pane 5 until the face 13 abuts it, leaving a PIB adhesive seal at least as deep as the groove 17 or well 19. The PIB sealant provides a temporary glue to hold the spacer 10 in place while a second pane 6 is manoeuvred into place.

The pane 6 is located using the flange 12 which protrudes from the other side of the spacer 10. Pane 5 is squeezed against pane 6 so that spacer face 14 abuts pane 6. As such, the PIB loaded in wells 19 and 20 is squeezed against the respective glass pane 5 and 6 so as to form the second seal elements 28. During assembly, it may be appreciated that the bevels 38 disposed at outer ends of the flanges 12 provide ramps 40 to facilitate loading of the panes 5 and 6 onto their respective flanges 12.

Once the spacer 10 has been applied to the inner faces of the panes 5 and 6, the axle 21 may be inserted though bore 11, and PIB is injected into the second well 37, adjacent the bevel 38. Clamping blocks 22 are then threadably applied to either end of the axle shaft 23, and the end faces 39 of the clamping blocks 22 abut the silicone washers 32 and 33 respectively, so as to form the first seal element 31. The geometric configuration of the clamping blocks 22 spread the support load from the mounting device 1 and are utilised to clamp the panes 5 and 6 against the first seal element 21 and second seal element 35 so as to inhibit pollution and leakage into the chamber 4 between panes 5 and 6.

It is important the PIB adhesive seal remains at least as deep as the well 19 and 20 to provide the second seal element 35. The required depth of the second seal element 35 is controlled by the volume of the PIB bead being greater than the volume of the wells 19 and 20 in addition to the torque applied to the clamping blocks 22 during tightening. Furthermore, if the glass panes 5 and 6 are at the smallest manufacturing tolerance for the thickness then the stops 25 and 26 will prevent over extrusion of the PIB sealant as well as the panes 5 and 6 from touching the spacer 10 ensuring the integrity of the second seal element 28. Furthermore, the stops 25 and 26 ensure that the clamping blocks 40 cannot be over tightened so that the glass panes 5 and 6 are not crushed or cracked.

The clamping blocks 22 also include gripping means 41 which may be actuated to apply a torque to tighten the clamping blocks 22. Furthermore, the gripping means 41 may be configured to receive a tool which allows a more secure load holding and spreading when tightening the clamping blocks 22 on the axle 21.

The axle 21 includes a bore 42 with an internal thread 43 into which an articulated ball joint assembly 45 may be engaged. The articulated ball joint assembly 45 is movable along the thread 43 of the bore 42 so that an installer may change the point of application of the shear load from the IGU 3 or remove an articulating ball joint assembly 45 altogether. The shear load of the IGU 3 is taken by the end of a stem 44 upon which the articulating ball joint assembly 45 is mounted. The articulating ball joint assembly 45 may move outwardly along the bore 42 until the shear load is taken mainly through the ball joint 45 itself, reducing shear forces on the stem 44 which transfers the load of the IGU 3 to a structure when the IGU 3 is installed. Additionally, the articulating ball joint assembly 45 and stem 44 can be removed from the bore 42 so as to facilitate flat packing of IGUs 3.

FIGS. 5 to 15 show another example of the mounting device 110 which works in a very similar way to the example shown in FIGS. 1 to 5.

Figure 5:
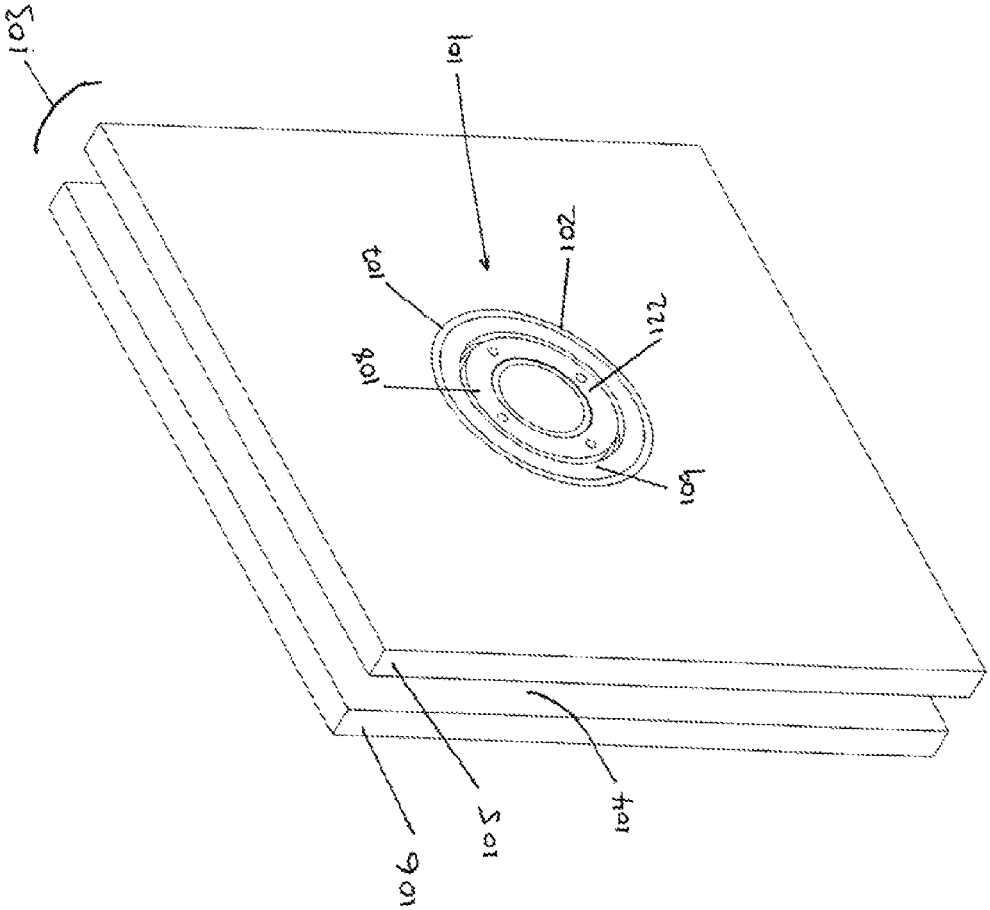
FIG. 5 is an isometric view of an IGU which is a second preferred embodiment of the present invention.

As may be appreciated from FIG. 5, in this example, the glass panes 105 and 106 have countersunk holes 107 and the clamping blocks 122 of point fixing apparatus 102 are in the form of a shee bolt 108 which has a first end 150 and a second end 151 that are likewise countersunk so as to present a substantially flush surface with the outer surface of the respect glass panes 105 and 106.

Figure 6:
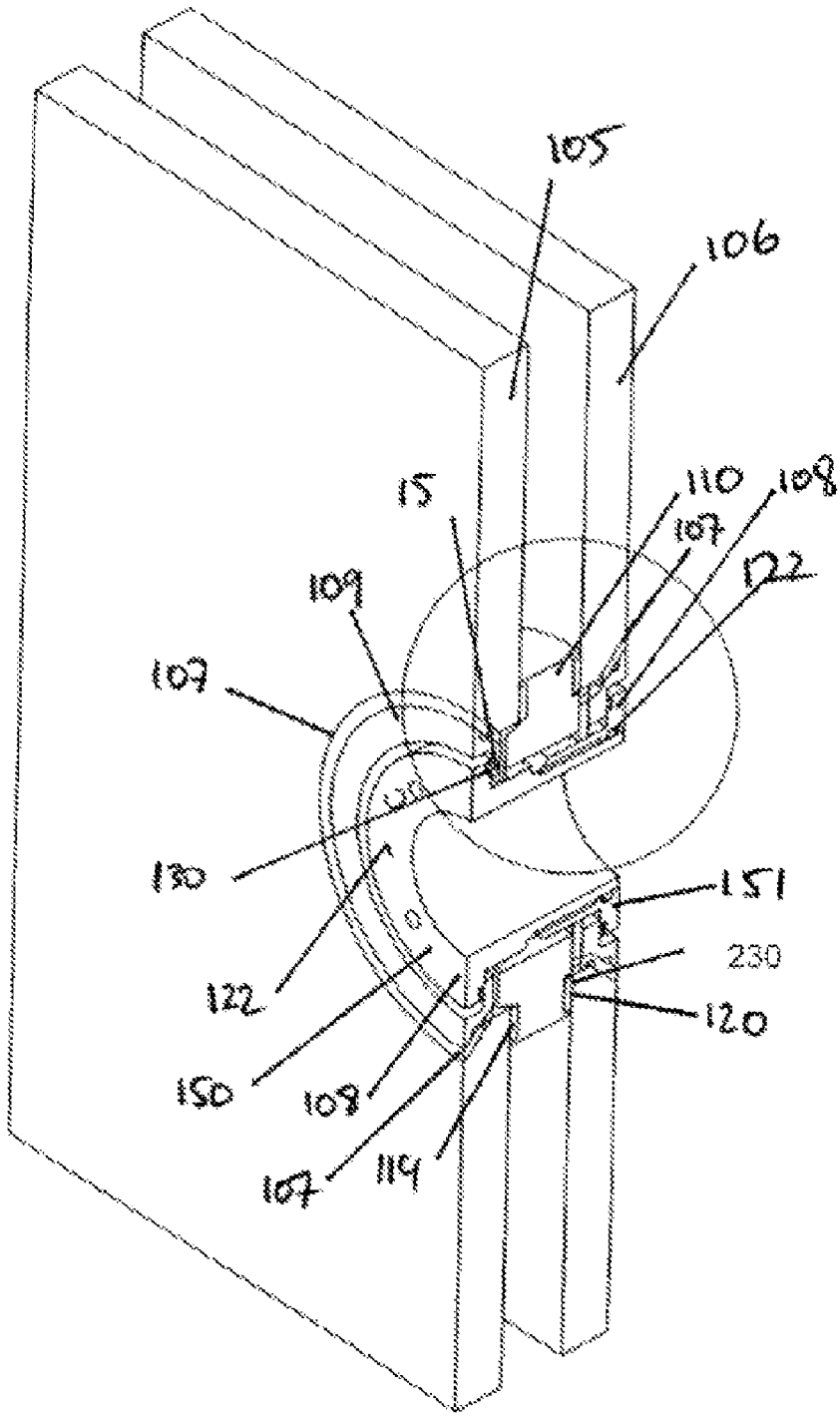
FIG. 6 is an isometric section view of the IGU shown in FIG. 5.

Referring now to FIG. 6, the shee bolt 108 includes a first end 150 and a second end 151 that may be coupled together, to clamp and retain the spacer 110 between the panes 105 and 106. Each of the glass panes 105 and 106 have a countersunk hole 107 into which countersunk bush 109 is seated to provide part of the seal apparatus 130.

The shee bolt 108 is configured to hold the countersunk bushes 109 against the panes 105 and 106. The shee bolt 108 includes a stop 125 to prevent over tightening of the apparatus 102. Finally, to improve sealing, the shee bolt 108, countersunk bushes 109 and washers include o-rings 152.

Figure 7:
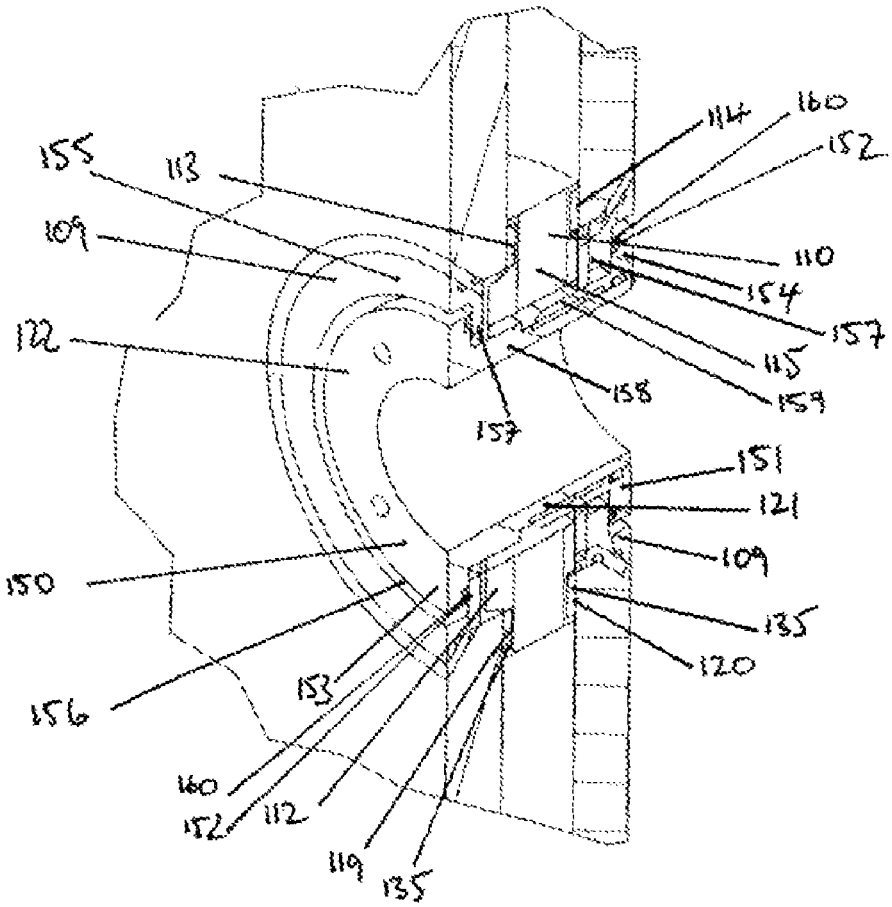
FIG. 7 is a detail view of a circled portion of FIG. 6.

FIG. 7 shows more detail of the configuration of the point fixing apparatus 102. In particular, the first and second ends 150, 151 of the of the shee bolt 108 have respective flanges 153, 154 which are configured to be smaller in diameter than the outer portions 155 of the respective countersunk bush 109 such that annular gaps 156 are formed. Accordingly, the first and second ends 150, 151 may move laterally within their respective annular gaps 156.

Accordingly, it may be appreciated the annular gaps 156 allows lateral play to exist between the first and second ends 150, 151 and their respective countersunk bushes 109. This lateral play is important when coupling the glass panes 105, 106 together if tolerances or other manufacturing variances are such that the axes of the countersunk holes 107 are not exactly aligned.

The diameter of the inner portion 157 of the countersunk bush 109 is configured to allow passage of the respective neck 158, 159 portions of the first and second ends 150, 151 of the of the shee bolt 108, however, whilst being small enough so that the flanges 153, 154 are seated on the inner portion 157 of the countersunk bush 109 when in a coupled condition.

Furthermore, the flanges 153, 154 have an annular channel 160 which retains the o-ring 152 which form part of the seal apparatus 230 between the first and second ends 150, 151 of the shee bolt 108 and the countersunk bush 109.

Figure 8:
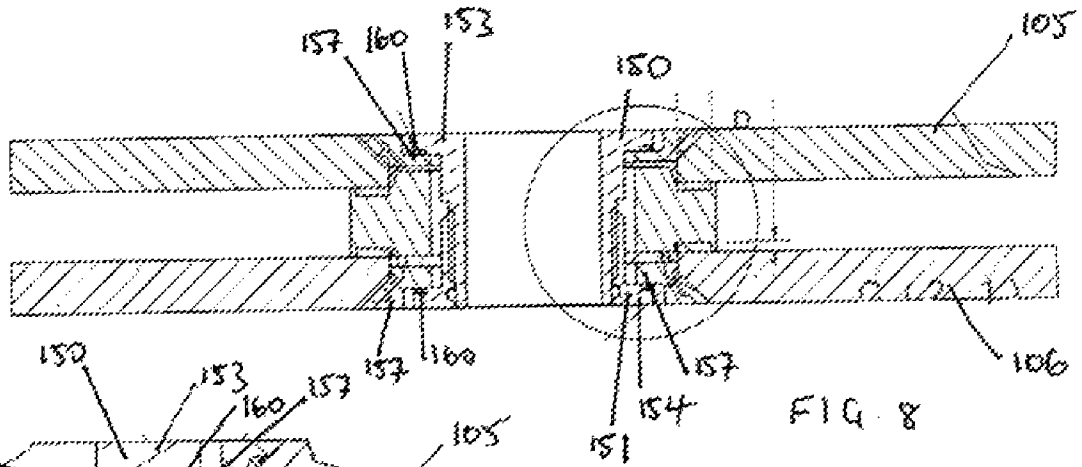
FIG. 8 is a section view in side elevation of the second preferred embodiment shown in FIG. 5.
Figure 9:
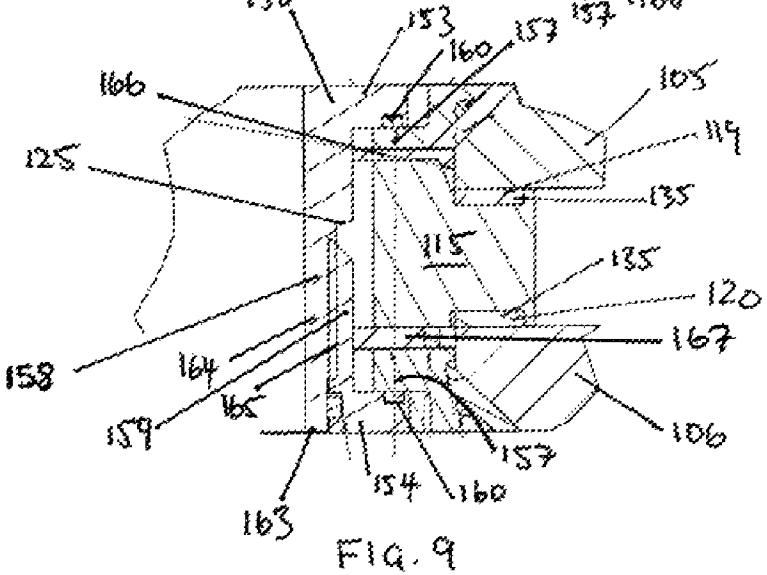
FIG. 9 is a detail view of a circled portion of the second preferred embodiment shown in FIG. 8.

As may be better appreciated from FIGS. 8 and 9, the annular channel 160 is configured to be a sufficiently set back from the inner portion 157 of the countersunk bush 109 such that the channel 160 maintains a fully seated position on inner portion 157 so as to maintain integrity of the seal apparatus 230, even when there may be a considerable amount of lateral play between the respective bush 109 and the first and second ends 150, 151 of the of the shee bolt 108. Additionally, washers 166, 167 are located between the underside of the respective bushes 109 and the top inner surfaces of the spacer 110. Each of the washers 166, 167 has a central hole sized to snugly fit over respective necks 158 and 159.

Furthermore, the countersunk bushes 108 have annular recesses 161 which are configured to receive PIB sealant to form yet another part of the seal apparatus 230 between the respective glass panes 105 and 106 and the countersunk bushes 109. Accordingly, when the first and second ends 150, 151 are engaged and tightened, as shown in, for example FIG. 8, the countersunk bushes 109 are compressed against the glass panes 105 and 106 so that an outer seal 162 is formed.

The configuration of the countersunk bushes 109 is particularly important as glass panes are typically not flat (for example the flatness of glass can vary as much as 6 mm per meter of length). As a result, when the countersunk holes 107 are drilled and the glass panes 105 and 106 are clamped together, axes of the holes 107 may not be coaxial. For example, each hole 107 may be laterally shifted relative to the other, as well have angular differences.

Accordingly, during assembly, the bushes 109 are prepared with a PIB bead in the inner recess 161 and are inserted into the countersunk drilled holes 107 of the glass panes 105 and 106. Importantly, the volume of the recess 161 is smaller then the volume of the PIB bead such that the over-volume of PIB is extruded between the bushes 109 and the respective tapered surfaces of the countersunk holes 107 of the glass panes 105 and 106. This allows the frustoconical surfaces of the bushes 109 and the respective glass panes 105 and 106 to pivot about the PIB bead so as to allow the first and second ends 150, 151 of the shee bolt 108 to be coaxial (despite variations in the axis of the holes 107) and maintain seal integrity whilst allowing for such manufacturing tolerances.

FIGS. 10*a*, 10*b* and FIGS. 11*a* and 11*b* show the countersunk bush 109 for use with the first end 150 of the shee bolt 108 as including a seating portion 168 and an insert portion 169. In use, the insert portion 168 is fastened within the seating portion 168 forming the countersunk bush 109 as shown in, for example, FIG. 9. Similarly, FIGS. 12*a*, 12*b* and FIGS. 13*a* and 13*b* show the countersunk bush 109 for use with the second end 151 of the shee bolt 108 as including an insert portion 169 that may be inserted to a seating portion 168 to form the countersunk bush 109.

FIGS. 14*a* to 14*c* illustrate further views of the spacer 110. As previously described the spacer 110 has annular grooves 117, 118 on both sides which form wells 119, 120. Spacer 110 has a central bore 111 skirted by a circumferential face 116, and a flange 112 extending peripherally around the circumferential face 116.

Referring to FIG. 15, the first end 150 of shee bolt 108 has an elongate neck 158 extending from the flange end 153 to an opposing end 163. As such, the neck 158 is long enough to substantially extend across the width of the IGU 103 (as may be see, for example, in FIG. 9). The neck 158 has a threaded portion 164 configured to engage with a corresponding receiving portion 165 on the neck 159 of the second end 151 of the shee bolt 108, when assembled.

In use, the first end 150 and the second end 151 may be advanced together until second end 151 abuts a shoulder 127 of the first end 150. This shoulder 127 forms a stop 125 which prevents over tightening of the shee bolt 108 when clamping the panes 105 and 106 onto the spacer 110. The first and second end 150, 151 also include gripping means that may receive a tool (not shown) for use in tightening the shee bolt 108.

As mentioned in relation to the first example, it is also important in this example that the PIB adhesive seal remains at least as deep as the wells 119 and 120 of the spacer 110 to provide the second seal element 135. The required depth of the seal is controlled by the volume of the PIB bead being greater than the volume of the wells 119 and 120 in addition to the torque applied to the shee bolt 108 (which provides clamping blocks 122) during tightening. Furthermore, if the glass panes 105 and 106 are at the smallest manufacturing tolerance for the thickness then the stop 125 will prevent over tightening of the shee bolt 108 so that the PIB sealant is maintained at a sufficient thickness and panes 105 and 106 are prevented from touching the spacer 110 ensuring that the integrity of the second seal element 135.

Referring to FIGS. 16 to 20 there is shown a third example of a mounting device 201, which comprises a point fixing apparatus 202 for use in assembly of and supporting an insulated glass unit (IGU) 203. The point fixing apparatus 202 in this example functions in a similar way to the examples of the point fixing apparatus illustrated in FIGS. 1 to 15. Not all parts will be described again, rather attention will be drawn to features and functionally which differ from that of the previous described examples.

Similarly to the previous example, the point fixing apparatus 202 includes a shee bolt 208 which passes through glass panes 205 and 206. In this example, however, the glass pane 206 is formed of double laminate glass. The shee bolt 208 includes a first end 250 coupled to a second end 251 so as to function as clamping blocks 222 to clamp the panes 205 and 206 onto a spacer 210 disposed between panes 205 and 206.

Referring now to FIGS. 17*a* to 17*c*, the spacer includes annular grooves 217 and 218 which form wells 219 and 220 into which PIB sealant may be disposed. As previously described, the PIB sealant in the wells 219 and 220 provides a second seal element 235. In this example, spacer 210 only has a flange 212 on one side and is substantially flat on the opposing side 280. Furthermore, a cylindrical collar 281 is provided around the shee bolt 208 between the opposing side 280 of the spacer 210 and the flange 254 of the second end 251.

Referring now to FIG. 18, in this example, the flange 253 of the first end 250 of the shee bolt 208 has a countersunk head 282 which, when in use, is seated on a countersunk bush 209, the bush 209 being located between the head 282 and the hole 207. The countersunk bush 209 includes an annular recess that, as described in relation to the second example, may receive PIB sealant so as to provide an outer seal 262.

As was described in relation the second example, the bush is 209 are prepared with a PIB bead in the inner recess 261 and is inserted into the countersunk drilled hole 207. The volume of the PIB is greater than the volume of the recess 261 such that the over-volume of PIB is extruded between the bush 209 and the tapered surface of the countersunk hole 107 of the glass pane 205. This allows the frustoconical surfaces of the bush 209 and the glass pane 205 to pivot about the PIB bead. This allows the first end 250 of the shee bolt 208 to be able to move so as to accommodate misalignment of holes 107 in the panes of glass 205, 206 and be coaxial with the second end 251.

The first end 250 has an elongate neck 258 extending from the flange end 253 to an opposing end 263. In this example, has an inner bore 283 with an outer threaded portion 284 and an inner hemispherical portion 284 which has a substantially smooth surface. Furthermore, the neck 258 has a threaded portion 264 configured to be engaged with a corresponding receiving portion 265 on the neck 259 of the second end 251 of the shee bolt 208, when assembled.

Furthermore, the second end 251 of the shee bolt 208 also includes a flange 254 which, when assembled, is seated in an outer face of the glass pane 206. The flange 254 includes an annular channel 260 which receives an o-ring 252 to provide a seal. The diameter of the flange 254 and annular channel 260 are configured to be substantially larger then the hole 207 in the pane 206. In this configuration, it may be appreciated that the flange 254 undergo some lateral movement relative to the hole 207 to accommodate misalignment of the holes and/or misalignment with respect to the first end 250 of the shee bolt 208. Additionally, the flange 254 provides a relatively large clamping surface on the outer face of the glass pane so as to distribute any clamping forces on the pane.

Referring now to FIG. 19, there is shown a threaded stem 244 with a rounded end 286 which is configured to be inserted into the inner bore 283 of the first end 250. A threaded collar 287, as illustrated in FIG. 20, is then slid over stem 244 toward the bore 283, and engaged with the outer threaded portion 284 of the bore 283 so as to retain the rounded end 286 within the hemispherical portion 284. As may be appreciated, the threaded stem 244, inner bore 283 and threaded collar 287 form a removable articulated ball joint assembly 245.

Referring to FIGS. 21*a* and 21*b* there is shown a fourth example of a mounting device 301, which comprises a point fixing apparatus 302 for use in assembly of and supporting an insulated glass unit (IGU) 303. The point fixing apparatus 302 in this example functions in a similar way to the examples of the point fixing apparatus illustrated in FIGS. 1 to 20. Furthermore, not all parts will be again described, rather attention will be drawn to features and functionally which differ from that of the previous described examples.

As illustrated in FIGS. 21*a* and 21*b*, in this example, the panes of glass 305 and 306 are coupled together by clamping blocks 322 engaged onto an axel 321, similar to the axle presented in the first example. Similarly to the third example, one of the glass panes 306 is double laminate, and is separated from the axel 321 by a cylindrical collar 381. To provide room for the collar 381 the spacer 310 has a flange 312 on only one side, however, the spacer 110 still has wells 319 and 320 on both sides that, when filled with the PIB sealant, form the second seal element 335. Further, it may be appreciated that the seal apparatus 330 of this example is similarly configured to that of the first example and also further includes a second well (or chamber) 337 for receiving flexible PIB sealant adjacent the flange 312. Additionally, a bevel 338 at the end of the flange 312 increases the size of the second well 337 so that a secure flexible PIB seal may be effected between the panes 305 and 306, flange 312 and internal diameters of the washers 332 and 333.

Similarly to example 1, the axle 321 includes shaft 323 having threaded ends 324 as well as stops 325 and 326 so as to inhibit clamping blocks 322 from overtightening the point fixing apparatus 302. Furthermore, the axle 321 includes a bore 342 with an internal thread 343 into which an stem 344, as shown in FIG. 22 may be inserted and secured by a threaded collar 387 so as to form an articulated ball joint assembly 345.

Advantageously, the point fixing apparatus described above (2, 102, 202, 302) is designed to be installed during automated process on an IGU assembly line. The method steps below generally apply all of above mentioned examples:

1. As the second pane of glass is transported into a press the first is being loaded with the spacer. The spacers have PIB seals pre-applied in the factory and a special insertion tool is used to align and pre-position the spacers in the holes. The flanges assist with this alignment. The adhesive nature of the PIB seal allows the spacers to remain in position on the first pane as it is processed into the press.
2. The first pane is loaded into the press and the IGU pressed together. This causes the PIB seal to be formed into the wells of the spacer whilst maintaining positional accuracy due to the flange on the spacer.
3. The assembled IGU proceeds out of the press to the next station and the secondary perimeter seal is applied.
4. The assembled IGU is taken from the line and the axle is inserted through the spacer and clamping blocks are attached. Alternatively, shee bolts (which provide clamping blocks) are used to couple the panes together. Additionally, if the glass has countersunk holes, countersunk bushes are inserted into the holes between the ends of the shee bolt and the glass.
5. The clamping blocks are pre-applied with Loctite Dryloc so after assembly the clamping blocks will not move due to vibration and thermal displacements.
6. During installation the clamping blocks require an initial setting torque of, for example, 22-26 Ft/Lbs. This further compresses the PIB seal (second seal element) as well as the seals between the glass and the fitting bushes and allows coaxial alignment of the clamping blocks. Testing shows that this initial torque setting relaxes to approximately 5 Ft/Lbs as the PIB seals reach their final flow form/destination after assembly.
7. The final assembled IGU is now ready for shipping without a protruding stem so the packaging etc is the same as for an IGU without holes. The ball joint stems are inserted on site without the fear of a contractor damaging the seal integrity of the IGU as the installation process begins.

Furthermore, for the benefit of the skilled addressee, the section below provides a list of variables and practicalities that may be considered when designing, manufacturing and installing the point fixing apparatus.

Glass

- Flatness tolerance of the different types of glass that can be used to make up an IGU.
- Thickness tolerance of the different types of glass that can be used to make up an IGU.
- Drilling accuracy of processing equipment used to place holes in the glass.
- Thickness tolerance of interlayer material in laminated glass.
- Material of interlayer in laminated glass.
- Maximum allowable compressive load of interlayer material in laminated glass make up.

Seal Material

- PIB (polyisobutylene). This material was chosen because of its mastic properties as well as its compatibility and non-reaction with soft-coats on the glass. PIB also has a molecular construct that will not allow argon gas through as well as not reacting chemically with the argon gas.

Bush and Donut Material

Ertalyte or polyethylene Terephtalate Polyester is the material chosen for the bush and donut this material has the gas out properties and molecular structure that will seal in argon and not react with it as well as having the lowest moisture transfer (condensation forming) attributes.

Torque Settings and PIB Volume

When the two panes of glass come together it is critical to get a uniform wet out of the PIB seal equal on both sides of the spacer. In effect it is best to position the spacer central between the glass panes. This is done with a combination of PIB volume/well size to torque setting such that the PIB is displaced completely into the well and also slightly bleeds over the edges of the well. If the torque setting is too high or the PIB volume to well size too small this may not be achieved.

Fixing the Finished IGU to the Building

When all of the point fixing apparatus are installed, the finished IGU, can be packed and transported to site in standard IGU shipping packs. The prior art shows that for each IGU in the pack the pack would need to be increased in width by at least the length of the fixing screw.

The articulating ball joint can be inserted in to the point fixing apparatus making the IGU packaging and installation much easier.

Because the point fixing apparatus uses articulated ball joints which are removable, the completed flat IGU may be used for faceted glass structures.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Finally, it is to be understood that the inventive concept in any of its aspects can be incorporated in many different constructions so that the generality of the preceding description is not to be superseded by the particularity of the attached drawings. Various alterations, modifications and/or additions may be incorporated into the various constructions and arrangements of parts without departing from the spirit or ambit of the invention.

LIST OF PARTS

1. Mounting Device
2. Point fixing apparatus
3. Insulated glass unit (IGU)
4. Insulating chamber
5. Glass pane
6. Glass pane
10. Spacer
11. Bore
12. Flange
13. Face
14. Face
15. Donut
16. Circumferential face
17. Annular groove
18. Annular groove
19. Well
20. Well
21. Axle
22. Clamping blocks
23. Shaft
24. Threaded ends
25. Stop
26. Stop
27. Shoulder
28. Axle end
30. Seal apparatus
31. First seal element
32. Washer
33. Washer
34. Silicone
35. Second seal element
36. PIB Sealant
37. Second well
38. Bevel
39. End faces
40. Ramps
41. Gripping means
42. Bore
43. Internal Thread
44. Stem
45. Articulated ball joint assembly
101. Mounting device
102. Point fixing apparatus
103. Insulated glass unit (IGU)
104. Insulating chamber
105. Glass pane
106. Glass pane
107. Countersunk holes
108. Shee bolts
109. Countersunk bush
110. Spacer
112. Flange
113. Face
114. Face
115. Donut
117. Annular groove
118. Annular groove
119. Well
120. Well
121. Axle
122. Clamping blocks
125. Stop
127. Shoulder
130. Seal apparatus
141. Gripping means
150. First end
151. Second end
152. O-ring
153. Flange
154. Flange
155. Outer portion
156. Annular gaps
157. Inner portion
158. Neck
159. Neck
160. Annular channel
161. Annular recess
162. Outer seal

163. Opposing end
164. Threaded portion
165. Receiving end
166. Washer
167. Washer
168. Seating portion
169. Insert portion
201. Mounting device
202. Point fixing apparatus
203. Insulated glass unit (IGU)
204. Insulating chamber
205. Glass pane
206. Glass pane
207. Countersunk holes
208. Shee bolts
209. Countersunk bush
210. Spacer
212. Flange
217. Annular groove
218. Annular groove
219. Well
220. Well
222. Clamping blocks
225. Stop
227. Shoulder
250. First end
251. Second end
252. O-ring
253. Flange
254. Flange
258. Neck
259. Neck
260. Annular channel
261. Annular recess
262. Outer seal
263. Opposing end
264. Threaded portion
265. Receiving end
280. Opposing side
281. Cylindrical collar
282. Countersunk hole
283. Bore
284. Threaded portion
285. Hemispherical portion
286. Rounded end
287. Threaded collar
301. Mounting device
302. Point fixing apparatus
303. Insulated glass unit
305. Glass pane
306. Glass pane
310. Spacer
312. Flange
319. Well
321. Axle
322. Clamping blocks
323. Shaft
324. Threaded ends
325. Stops
326. Stops
330. Seal apparatus
332. Washer
333. Washer
335. Second seal element
337. Second well
338. Bevel
342. Bore
343. Thread
344. Stem
345. Articulated ball joint assembly
381. Collar
387. Threaded collar

The invention claimed is:

1. A device for providing a fixing point for an insulated glass unit, the device having clamping blocks to mount the device in holes provided in opposed panes of glass of the unit and a unitary spacer with a bore through which the clamping blocks are connected, the spacer having opposed faces provided with an annular groove for carrying sealant to seal against an associated one of the glass panes when the glass panes are tensioned together by the clamping blocks, wherein the spacer includes a flange to locate the spacer in one of the holes and wherein the spacer provides a solid unitary body that extends from the bore through to a periphery thereof and the annular grooves are in the form of wells recessed into opposed sides of the body and adapted to receive the sealant prior to the spacer being fitted between the panes of glass, wherein the clamping blocks are coupled together by a threaded coupling which passes through the unit, the threaded coupling having a pair of opposing stop devices, each of the opposing stop devices being formed on opposing ends of the threaded coupling, one of the opposing stop devices comprising an annular shoulder stop protruding outwardly from one end of the threaded coupling, and the other one of the opposing stop devices comprising an annular end stop protruding inwardly from the opposing end of the threaded coupling, wherein each of the clamping blocks carries a seal to engage with the opposed panes of glass.

2. The device of claim 1, wherein the flange is an integral annular flange which projects axially of one of the faces of the spacer.

3. The device of claim 2, wherein an end of the flange is beveled to facilitate easy insertion in the hole.

4. The device of claim 2, wherein the spacer includes a second annular flange projecting axially of the other one of the faces so as to locate in the other one of the holes.

5. The device of claim 1, wherein the clamping blocks are formed of two nuts, arranged to be screw threaded onto an axle which extends therebetween, through the glass unit.

6. The device of claim 1, incorporating the sealant which is formed of polyisobutylene material.

7. The device of claim 6, wherein the sealant is filled in the annular groove to a depth at least as deep as the annular groove.

8. The device of claim 1, wherein one of the clamping blocks is adapted to carry a stem for mounting the glass unit to a supporting structure.

9. The device of claim 8, wherein the stem is removable to allow the glass unit to be flat packed.

10. The device of claim 1, wherein the spacer provides a solid unitary body that extends from the bore through to a periphery thereof and the annular grooves are in the form of wells recessed into opposed sides of the body and adapted to receive the sealant prior to the spacer being fitted and clamped between the panes of glass such that no additional sealant material is needed to seal between the spacer and the glass panes.

11. A spacer for use in the device of claim 1, the spacer being formed as a unitary structure with a flattened donut shape, with annular grooves formed on opposed faces thereof, and an integrally formed flange to locate the spacer in a corresponding hole formed in a pane of glass, wherein the spacer provides a solid unitary body that extends from the bore through to a periphery thereof and the annular grooves are in the form of wells recessed into opposed sides of the body and adapted to receive the sealant prior to the spacer being fitted between the panes of glass.

12. The spacer of claim 11, wherein the flange projects axially of one of the faces of the spacer.

13. The spacer of claim 12, wherein an end of the flange is bevelled to facilitate easy insertion in a hole of a pane of glass of an integrated glass unit.

14. The spacer of claim 11, further including a second annular flange projecting axially of the other one of the faces.

15. The spacer of claim 11, wherein the spacer provides a solid unitary body that extends from the bore through to a periphery thereof and the annular grooves are in the form of wells recessed into opposed sides of the body and adapted to receive the sealant prior to the spacer being fitted and clamped between the panes of glass such that no additional sealant material is needed to seal between the spacer and the glass panes.

16. A clamping block structure for an insulated glass unit, including clamping blocks sealed on opposed panes of glass, wherein the clamping blocks are coupled together by a threaded coupling which passes through the unit, the threaded coupling having a pair of opposing stop devices to inhibit over tensioning of the panes of glass clamped between the clamping blocks, each of the opposing stop devices being formed on opposing ends of the threaded coupling, one of the opposing stop devices comprising an annular shoulder stop protruding outwardly from one end of the threaded coupling, and the other one of the opposing stop devices comprising an annular end stop protruding inwardly from the opposing end of the threaded coupling, wherein each of the clamping blocks carries a seal to engage with the opposed panes of glass.

17. The clamping block structure of claim 16, wherein the clamping block structure is adapted to couple to a device for providing a fixing point for an insulated glass unit, the clamping blocks adapted to mount the device holes provided in opposed panes of glass, the clamping blocks adapted to tension together the glass panes.

* * * * *

UNITED STATES PATENT AND TRADEMARK OFFICE

CERTIFICATE OF CORRECTION

PATENT NO. : 8,375,680 B2
APPLICATION NO. : 12/723549
DATED : February 19, 2013
INVENTOR(S) : Murray Robert Clair et al.

It is certified that error appears in the above-identified patent and that said Letters Patent is hereby corrected as shown below:

In the Claims

Column 16, Line 16:
"blocks adapted to mount the device holes provided in" should read, --blocks adapted to mount the device in holes provided in--.

Signed and Sealed this
Thirtieth Day of July, 2013

Teresa Stanek Rea
*Acting Director of the United States Patent and Trademark Office*